US007370908B2

(12) United States Patent
Crowell

(10) Patent No.: US 7,370,908 B2
(45) Date of Patent: May 13, 2008

(54) COLLAPSIBLE PORTABLE PLATFORM

(76) Inventor: Robert L. Crowell, 177 Weaver St., Boone, NC (US) 28607

( * ) Notice: Subject to any disclaimer, the term of this patent is extended or adjusted under 35 U.S.C. 154(b) by 21 days.

(21) Appl. No.: 11/448,744

(22) Filed: Jun. 8, 2006

(65) Prior Publication Data

US 2007/0013211 A1 Jan. 18, 2007

Related U.S. Application Data

(60) Provisional application No. 60/688,380, filed on Jun. 8, 2005.

(51) Int. Cl.
*A47C 4/00* (2006.01)

(52) U.S. Cl. ..... 297/16.2; 248/164; 108/118

(58) Field of Classification Search ..... 297/16.2, 297/16.1, 344.18; 248/164; 108/118
See application file for complete search history.

(56) References Cited

U.S. PATENT DOCUMENTS

| | | | | |
|---|---|---|---|---|
| 105,222 | A | 7/1870 | King | |
| 402,709 | A | 5/1889 | Abbott | |
| 772,316 | A * | 10/1904 | Mock | 108/118 |
| 1,205,057 | A | 11/1916 | Sulenski | |
| 1,240,119 | A | 9/1917 | Burns | |
| 3,084,896 | A | 4/1963 | Alexiou | |
| 3,376,069 | A | 4/1968 | Lowdermilk | |
| 3,414,323 | A | 12/1968 | Mitchum | |
| 4,266,748 | A | 5/1981 | Dalton | |
| D282,320 | S | 1/1986 | Anderson | |
| 4,810,029 | A | 3/1989 | Kaladis et al. | |
| 4,934,638 | A | 6/1990 | Davis | |
| 5,709,428 | A | 1/1998 | Hugghins | |
| 6,125,769 | A | 10/2000 | Tsai et al. | |
| 6,634,704 | B1 * | 10/2003 | Bergquist | 297/16.2 |
| 6,676,208 | B2 | 1/2004 | Lu | |
| 6,871,905 | B2 | 3/2005 | Grace | |

* cited by examiner

*Primary Examiner*—Anthony D. Barfield
(74) *Attorney, Agent, or Firm*—James W. Hellwege

(57) ABSTRACT

A portable platform having at least three outwardly-inclined legs and a platform supported thereby is provided, the legs each having multiple nestable sections, an uppermost portion of each of the legs being adapted to be attached to an underside of said platform, the legs being maintained in biased relationship to an underside of the platform by an elastic cord or cable which extends between the underside of the platform and a lowermost section of the legs, with the elastic cord or cable extending through each of the respective sections of the legs, with the elastic cord or cable being tensioned such that the sections of the legs may be separated from one another and folded onto an uppermost surface of said platform in storage relationship thereto, with the platform being comprised of dimensionally-stable foldable sections.

17 Claims, 8 Drawing Sheets

COLLAPSIBLE PORTABLE PLATFORM

BACKGROUND OF THE PRESENT INVENTION

Many types of portable stools or platforms are known in the art. See, for example, U.S. Design Pat. No. 282,320; and U.S. Pat. Nos. 105,222; 402,709; 1,205,057; 1,240,119; 3,084,896; 3,376,069; 3,414,323; 4,266,748; 4,810,029; 4,934,638; 5,709,428; 6,125,769; 6,676,208; and 6,871,905.

Several of the disclosed designs are more portable than others. However, a need exists for a portable seat or platform which folds into a size such that the folded seat or platform may be carried in a pocket or fanny pack. A need further exists for a portable foldable seat or platform which is comfortable to sit upon, as well as exhibiting such strength that it may support up to 400 lbs.

SUMMARY OF THE PRESENT INVENTION

The present invention is thus directed to a collapsible portable platform.

The portable platform has at least three legs and can be used as a stool, chair, seat, table, etc.

The platform is comprised of a folding top portion which serves as a platform, and at least three folding legs that can be folded onto the uppermost portion of the foldable top portion, with sections of the top portion folding proportionally inwardly to accept the folded legs in an encompassing storage position.

The platform, when folded, is of a size and shape suitable for storage and/or transportation in a pocket, fanny pack, backpack, glove box, etc.

BRIEF DESCRIPTION OF THE DRAWINGS

FIG. 3 is a bottom view of the platform upon being folded.

FIG. 4 is a top view of the platform upon being folded.

FIG. 5 is a side view of the platform upon being folded.

DETAILED DESCRIPTION OF THE PRESENT INVENTION

Figure 1:
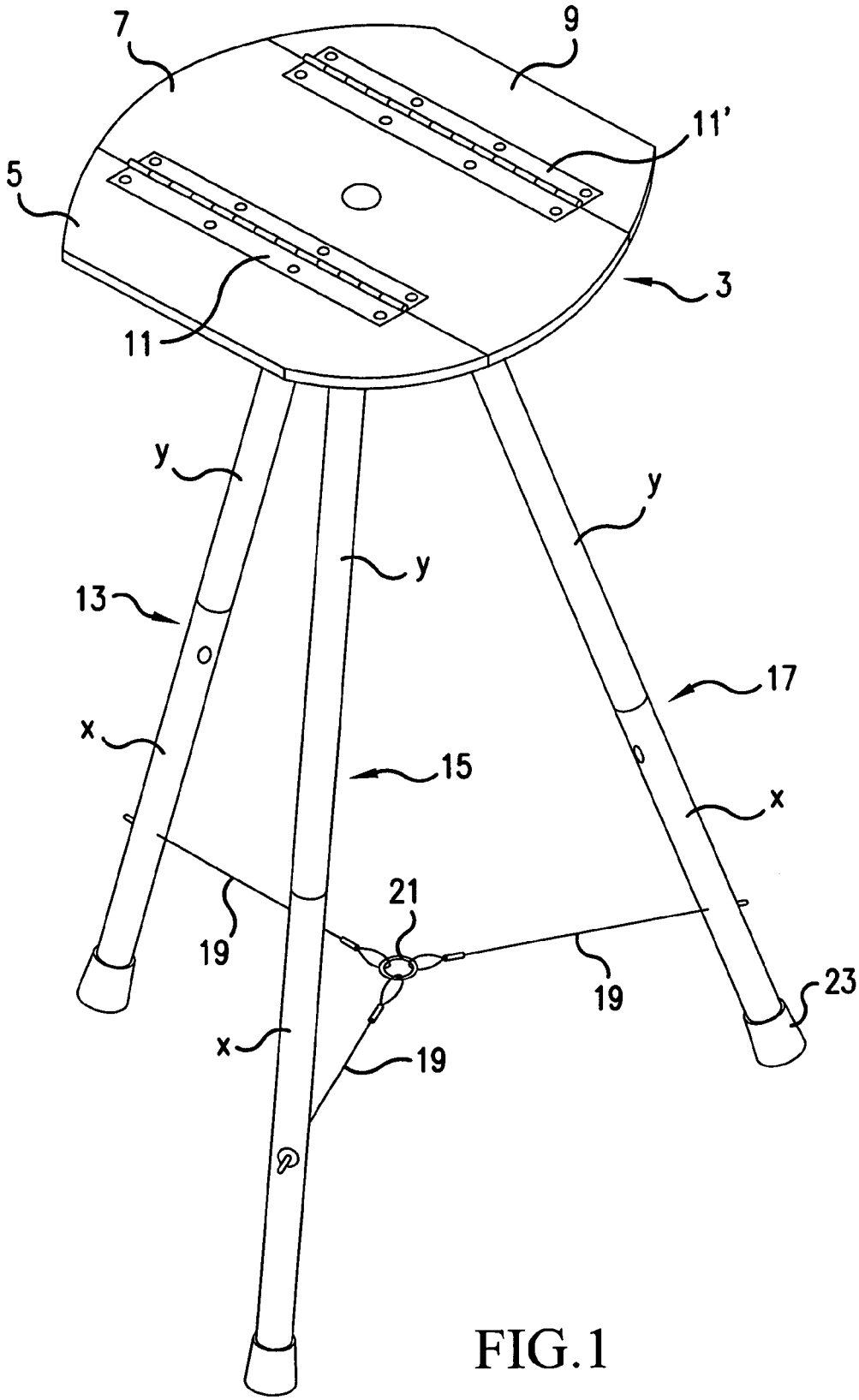
FIGS. 1 and 2 are views of two embodiments of the portable platform of the present invention upon being assembled for use.

The present invention will be described in conjunction with FIGS. 1-10 as discussed in detail below.

The portable foldable platform 1 comprises a horizontally-disposed platform 3 having foldable sections 5, 7, and 9. Hinge means 11, 11' connect the foldable hinged sections 5, 7, 9 to permit the outermost sections 5, 9 to fold upward and inwardly toward middle section 7.

Legs 13, 15, 17 extend from the bottom of the platform 3. The legs as depicted are comprised of multiple nestable sections x, y which, when assembled or nested together, support the foldable platform 3 a distance from the ground substantially corresponding to the length of the assembled legs. While three legs are depicted, and the use of three legs is preferable, it is also possible for the platform to be supported by more than three legs such as, for example, four legs. While two leg sections x,y are depicted in the drawings, more than two sections may be employed as desired. For example, three or more nestable or connectable leg sections may be employed.

Figure 2:
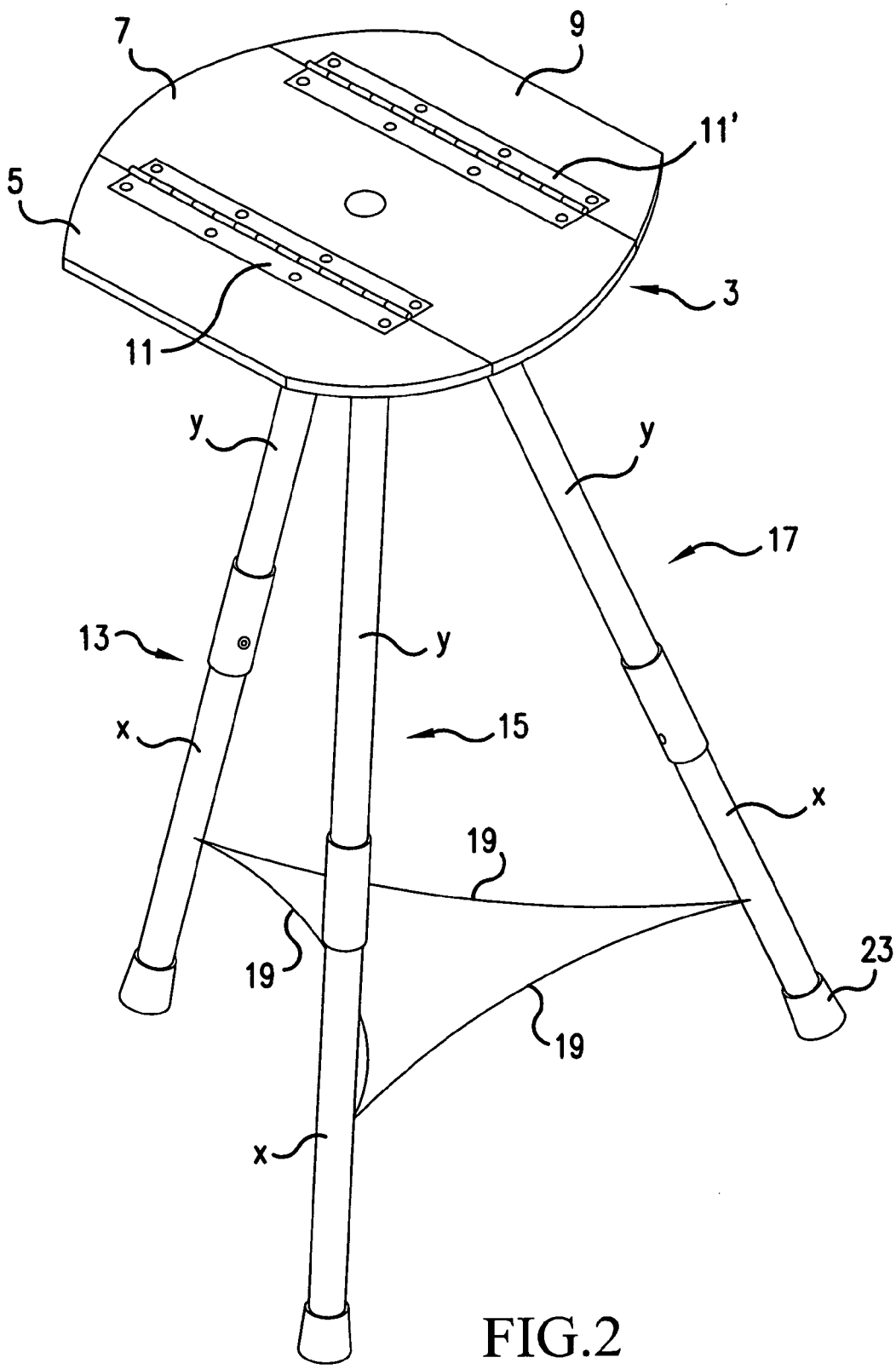

The legs 13, 15, 17 are preferably stabilized by cables/wires 19 which may be interconnected at a common connection 21. The connecting cables/wires prevent the assembled legs from extending laterally to an extent such that the legs no longer provide adequate structural support for the platform 3. The cables/wires 19 are preferably connected to each lowermost leg section to maximize the ability to provide stability to the platform. In FIG. 1, cables/wires 19 connect to a common center point 21. In FIG. 2, cables/wires 19 connect and extend laterally between adjacent leg portions, as opposed to being connected at a common center point 21.

The respective leg sections may be fastened together by any suitable means. For example, opposing ends of the legs may be configured to nest within one another, whereby the end of one leg has a lesser diameter than the opposing end of an adjacent leg. The legs may either be friction fit together, or other attachment means such as matching holes and buttons may be used to ensure a good fit. A cam-like attachment sleeve means may also be employed whereby a sleeve on one leg section fits over the end of an adjacent leg section, with an interlocking fit being obtained upon twisting of the sleeve about the adjacent leg section to engage a pin or protrusion within a groove in the sleeve.

Inner and outer sleeves may also be employed to provide nestable or connectable leg sections. Inner sleeves may be provided which are configured to fit within the bores of adjacent leg sections, with an intermediate shoulder on the inner sleeve serving as a spacer between the opposing ends of the leg sections. See FIGS. 7A and 8A in this regard.

Alternatively, it has been found to be preferable, to assist in maintaining the nestable legs in assembled form, to provide elastic cables/cords 27 within the interior of the leg members whereby tension may be maintained between opposing ends of the nested leg portions. One end of the elastic cable/cord is connected to the lowermost leg sections x, and the other end of the elastic cable/cords is connected to the middle foldable section 7 of the platform 3 after extending through adjacent leg section y. It has been found preferable for the cable/cord to be attached to an interior portion of the bottom-most leg section x at a point near the bottom end of the leg section such as by attachment to a rivet, etc., within the leg. Attachment at that point maximizes the length of the elastic cable/cord that may be stretched upon the legs being disassembled.

The elastic cable/cord is dimensioned such that the respective leg sections, when nested, are maintained in a tensioned or biased relationship with respect to each other—i.e., upon assembly, the respective leg sections are maintained in a biased relationship toward the bottom of the platform 3, specifically the bottom of platform section 7. A thickness of from ⅛ to 3/16 inch has been found useful for the elastic cable/cord.

The bottom ends of the legs 13, 15, 17 preferably include end caps 23 which serve to seal the ends of the leg members.

In order to assist in preventing the ends of the legs from sinking into a soft surface, the end caps may be flared outwardly to provide enhanced surface contact by the ends of the legs.

In order to provide a platform which swivels, the uppermost ends of legs 13, 15, 17 may be attached to a swivel member 25 attached to the bottom of platform section 7 by suitable means such as a nut/bolt assembly. When assembled, and when used, the platform 3 may thus swivel to permit ease of use of the platform.

When a swivel is present, the uppermost end of the elastic cable/cord is attached to swivel member 25. In a preferred embodiment, the elastic cable/cord enters a hole or channel in the swivel, with the cable/cord being tied off or fixed to the swivel in a manner which will maintain the cable/cord under tension when in use (see FIGS. 7 and 8). In this manner, the legs may be attached to the bottom of the swivel without impeding the ability of the swivel to rotate about the bottom of the platform 3. The swivel member may be comprised of any suitable material having sufficient dimensional stability, such as an engineering plastic such as a polycarbonate, or wood, etc.

The top end of the legs may be attached to the bottom of the platform in any suitable manner. For instance, the legs may be seated upon downwardly-extending short pegs (not shown) attached to the bottom of the platform sized to snugly fit inside each hollow leg. to maintain each leg in the desired position. Each short peg would be angled outwardly so that the distance between the legs would increase as shown in FIG. 1. The short pegs can be inclined approximately 15-20° to the vertical axis with advantage. The short pegs may be attached to either the bottom of platform section 7 (in which case a swivel means would not be employed, or to the bottom of the swivel member 25 (if it is desired to have a swivel function).

Alternatively, the top ends of the legs may be seated in correspondingly sized holes 29 in the bottom of, for example, a swivel 25. In order to assist in orienting the legs toward the ground, the holes are angled outwardly so that the legs, when seated in the holes, are outwardly angled so that the distance between the legs increases as the legs extend toward the ground as shown in FIGS. 1 and 2. It has been found that holes approximately 0.5 inch deep and inclined approximately 20° to the vertical axis are suitable. An angle of inclination ranging from 15-20° will generally suffice. The degree of inclination may vary and is, for example, dependent upon the end use of the platform. For instance, when used as a seat, it is preferable for the angle of inclination to be relatively small to increase the ability of the legs to support a load.

A platform height of from 15-20 inches has been found to be suitable for the platform to serve as a seat. Of course, the ultimate height depends upon the number of leg sections employed. It has been found that leg sections of approximately 7-10 inches in length are satisfactory, and assist in providing a compact folded platform.

The fitting to which the legs are attached may swivel (such as by being attached by means of a bolt and washer) or be fixed to the bottom of the platform so as to not swivel.

While the legs are shown in the drawings as being comprised of two nestable sections, any number of nestable sections may be employed. Further, it is possible to provide extensible portions for at least one leg section in each leg so that the length of each leg may be modified without adding additional leg sections. For example, a sleeve section to which the bottom of the leg is attached may be slideably engaged with the next adjacent section with pin or button/hole engaging means to maintain the respective portions in fixed relationship at the desired axial position. In the embodiment where three legs are employed, it is only necessary to provide a single leg which is extensible in order to provide adequate leveling on non-level ground.

FIGS. 7, 7A, 8 and 8A depict various embodiments depicting how the nestable leg sections may be connected to one another.

Figure 7A:
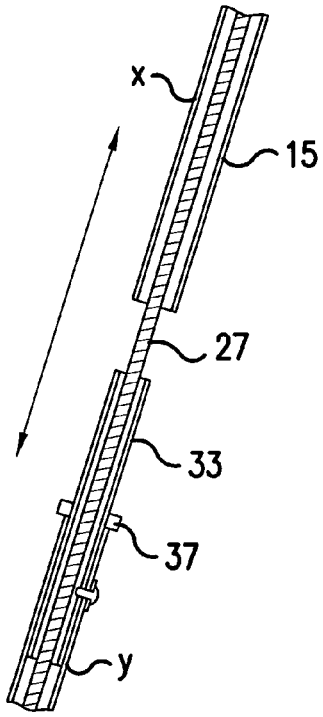
FIG. 7A is an exploded view of a portion of FIG. 7.
Figure 7:
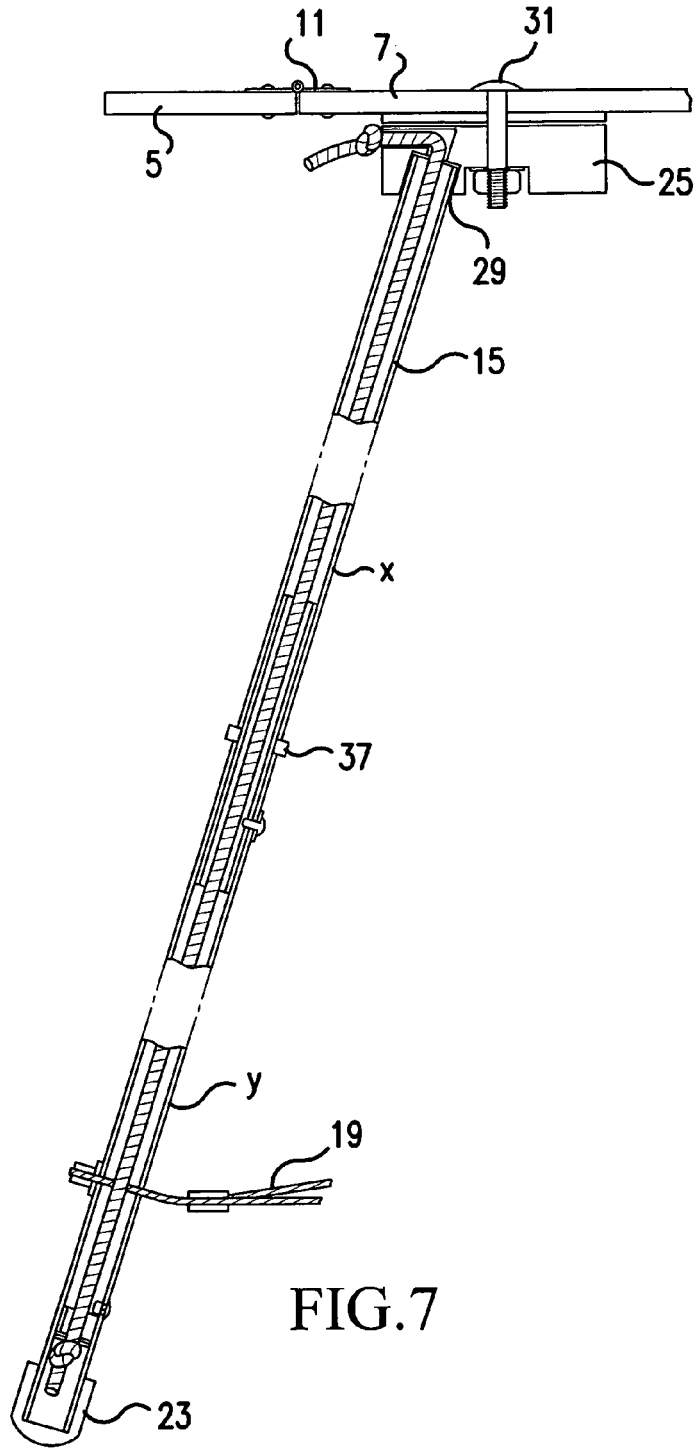
FIG. 7 is a cross-sectional view of one embodiment of the joint between two adjacent leg sections.

FIGS. 7, 7A depict an embodiment where leg sections x,y of leg 15 have an internal sleeve 33 having opposing ends which fit within opposing ends of leg sections x,y. Shoulder section 37 abuts the respective opposing ends of leg sections x,y to provide an abutment there-between and cushioning the leg sections from each other. FIG. 7 also depicts swivel member 25 having holes 29 into which an end of leg 15 is inserted. FIG. 7 also depicts an end of elastic cable/cord 27 extending from an open end of leg 15 through hole 29 and through a bore of the swivel member 25 to be secured thereto by suitable means such as a knot. The elastic cable/cord 27 is also secured at the opposing end of leg 15 within the interior thereof by suitable means such as by a knotted portion. Swivel member 25 is attached to platform section 7 by suitable means such as a nut and bolt assembly 31. This permits the platform portion to swivel about the legs upon use if so desired.

Figure 8A:
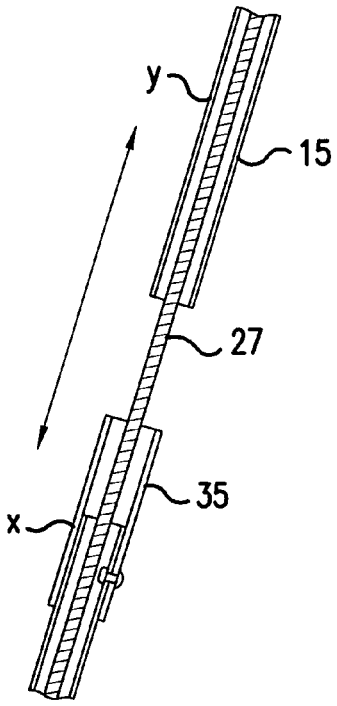
FIG. 8A is an exploded view of a portion of FIG. 8.
Figure 8:
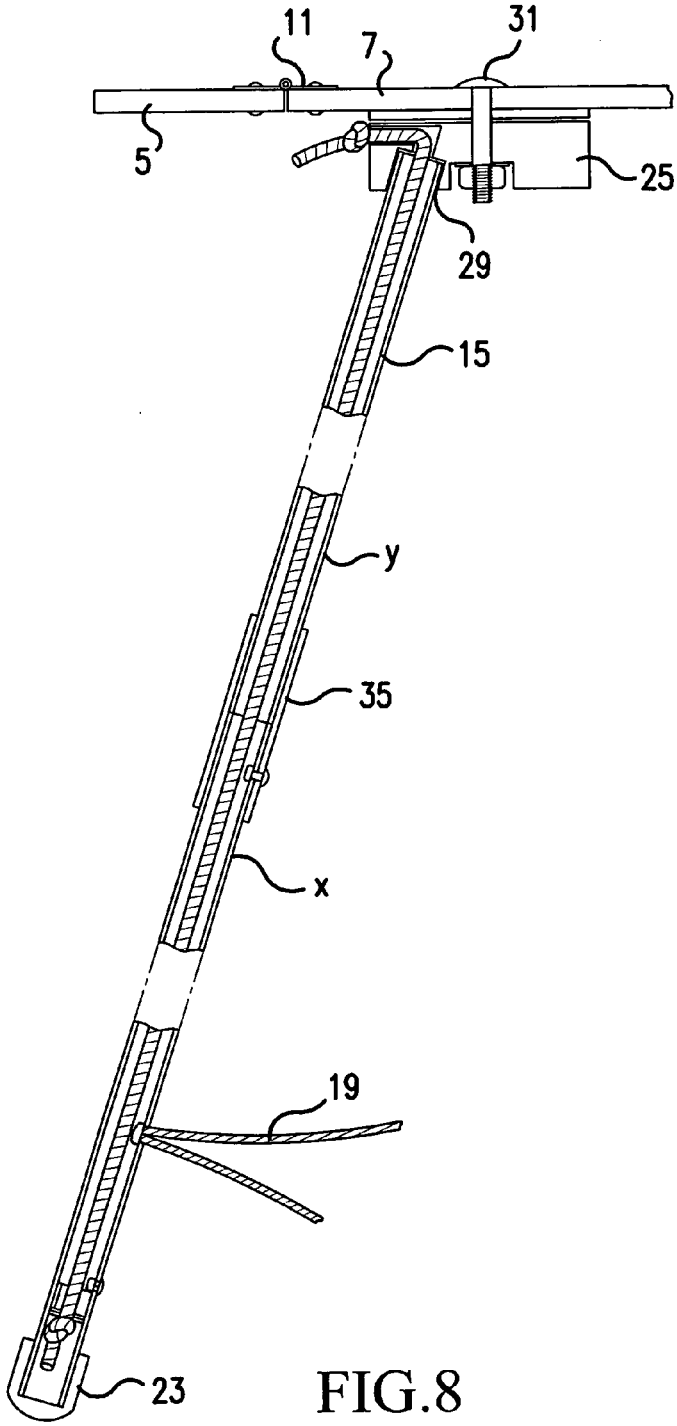
FIG. 8 is a cross-sectional view of another embodiment of the joint between two adjacent leg sections.

FIGS. 8, 8A depict an alternative embodiment to FIGS. 7, 7A. The embodiment of FIGS. 8, 8A differs from that of FIGS. 7, 7A in that an external sleeve 35 is employed instead of an internal sleeve 33 as in FIGS. 7, 7A. The external sleeve is attached at one end thereof to an end of one section of leg 15. As depicted, an end of sleeve 35 is attached to an end of leg section x, such that leg 15 is assembled by insertion of a bottom end of leg portion y into the open end of sleeve 35.

Figure 3:
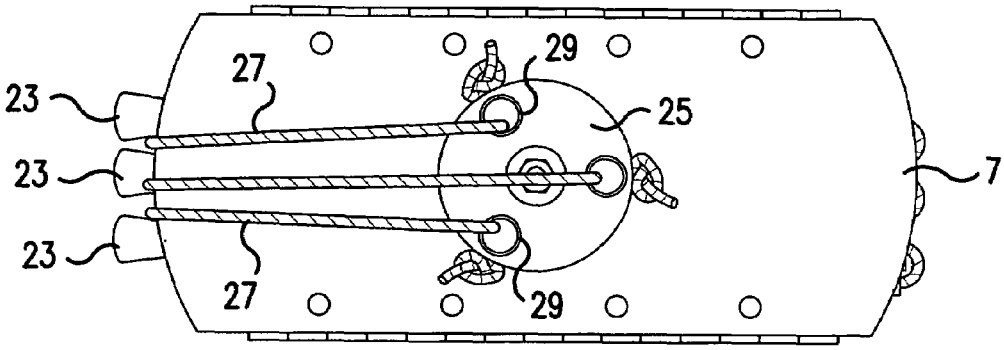
FIGS. 3-5 are views of the portable platform of the present invention when folded for storage or transportation.
Figure 4:
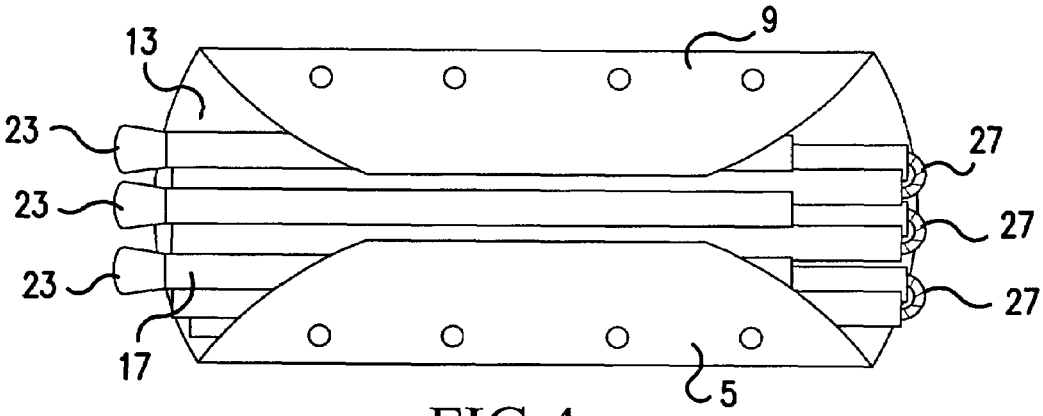
Figure 5:
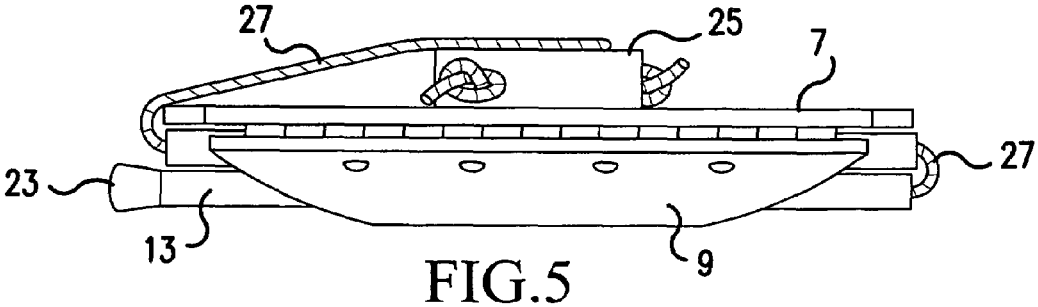
Figure 6:
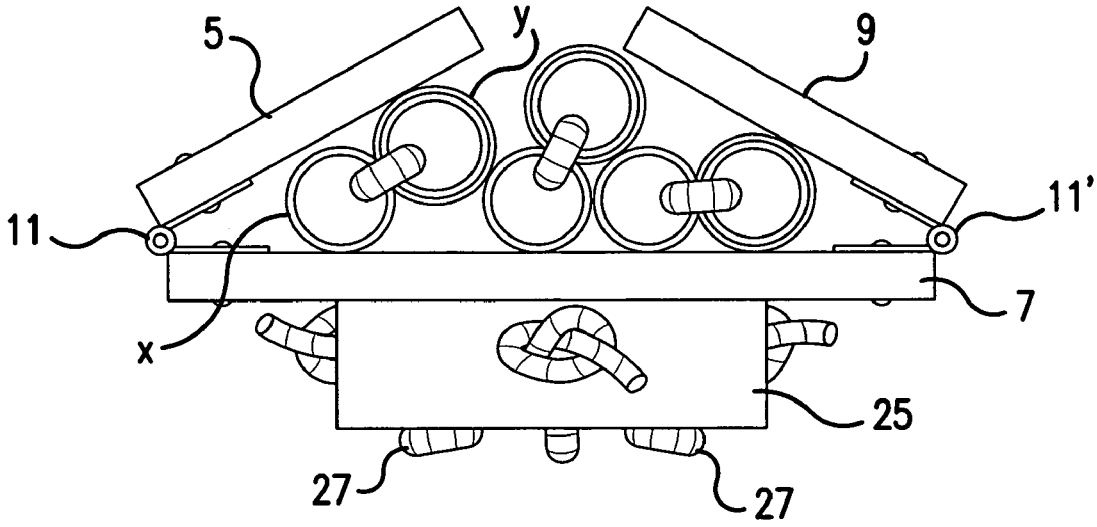
FIG. 6 is an end view of the platform upon being folded.

In operation, the platform of FIG. 1 or 2 is folded in the following manner. The legs are removed from engagement with the holes in the bottom of the swivel. The legs are then caused to be pulled together horizontally such that the top ends of the legs are extended to a point outside of the lateral edge of the platform 3. This will cause the elastic cable/cord to be stretched and placed under tension as shown in FIGS. 3 and 5. The legs are then laid down upon the top of the platform substantially parallel to each other as shown in FIG. 4. The bottom sections of the legs may then be pulled from nesting engagement with the top portion of the legs and folded back upon the top of the platform adjacent the other leg sections as shown in FIGS. 4 and 6.

Once folded upon the top of the platform 3, the side sections 5, 9 of the platform may be folded up and onto the folded leg portions to assist in maintaining the leg sections in storage position. It is also desirable to provide a looped elastic member (not shown) attached to the bottom of the platform 3 which may be looped over the folded platform sections to maintain the folded sections in contact with the leg sections while under tension.

The platform sections may be comprised of any suitable material having the desired dimensional stability which can serve as a seat, table, etc. The use of plywood as a platform material has been found to be suitable, although the platform sections may be comprised of a metal such as aluminum, plastic, etc. No limitation exists regarding the type of material employed except that the material should be sufficiently load bearing and not so heavy as to reduce the portability of the platform. A cover (such as a fabric cover) may also be provided to enhance the appearance of the platform. It is also desirable to place a padding material (such as a foamed material) between the fabric and the top surface of the platform to cushion the seat.

The legs are comprised of any material which provides acceptable supporting strength. Aircraft aluminum has been used with success. The legs may also be made of wood, carbon fiber, structural metals such as steel, etc. However, it is desirable to employ a material which is not unduly heavy in the event that the portable platform is intended to be lightweight.

Figure 9:
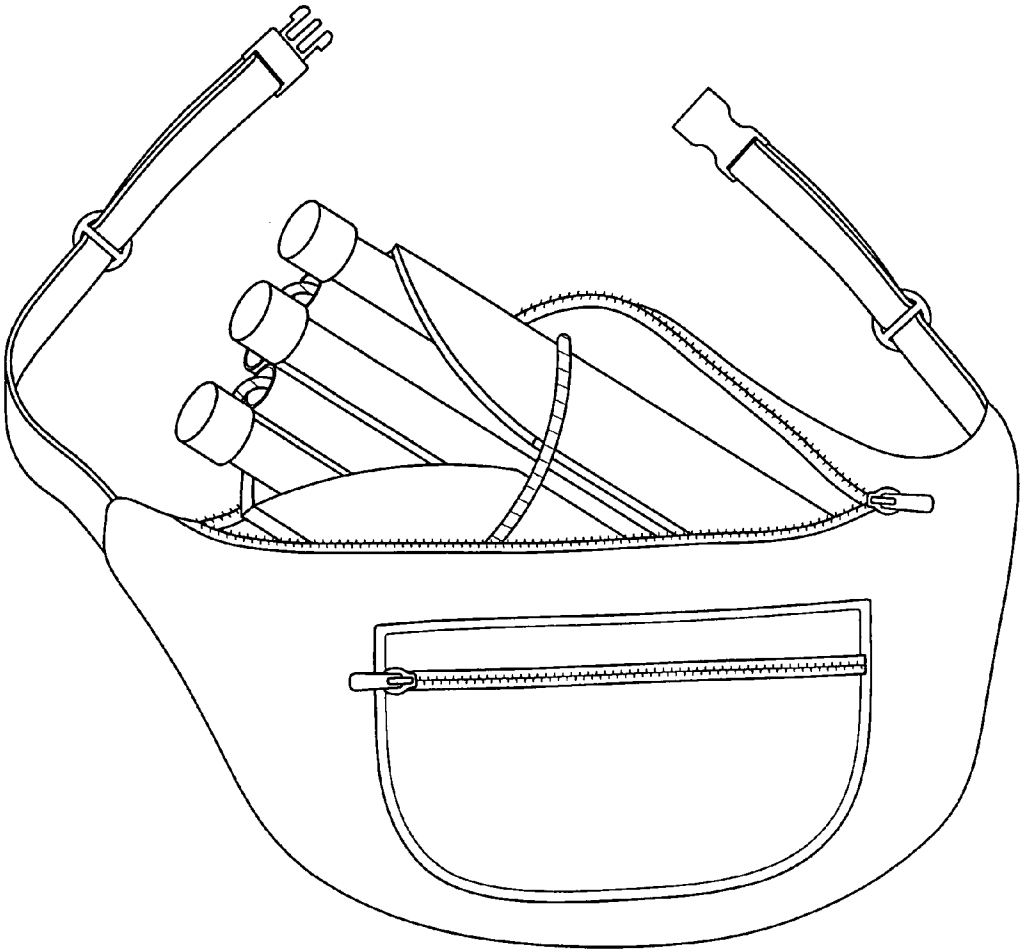
FIG. 9 is a view in perspective of the folded platform of the present invention being stored in a fanny pack.
Figure 10:
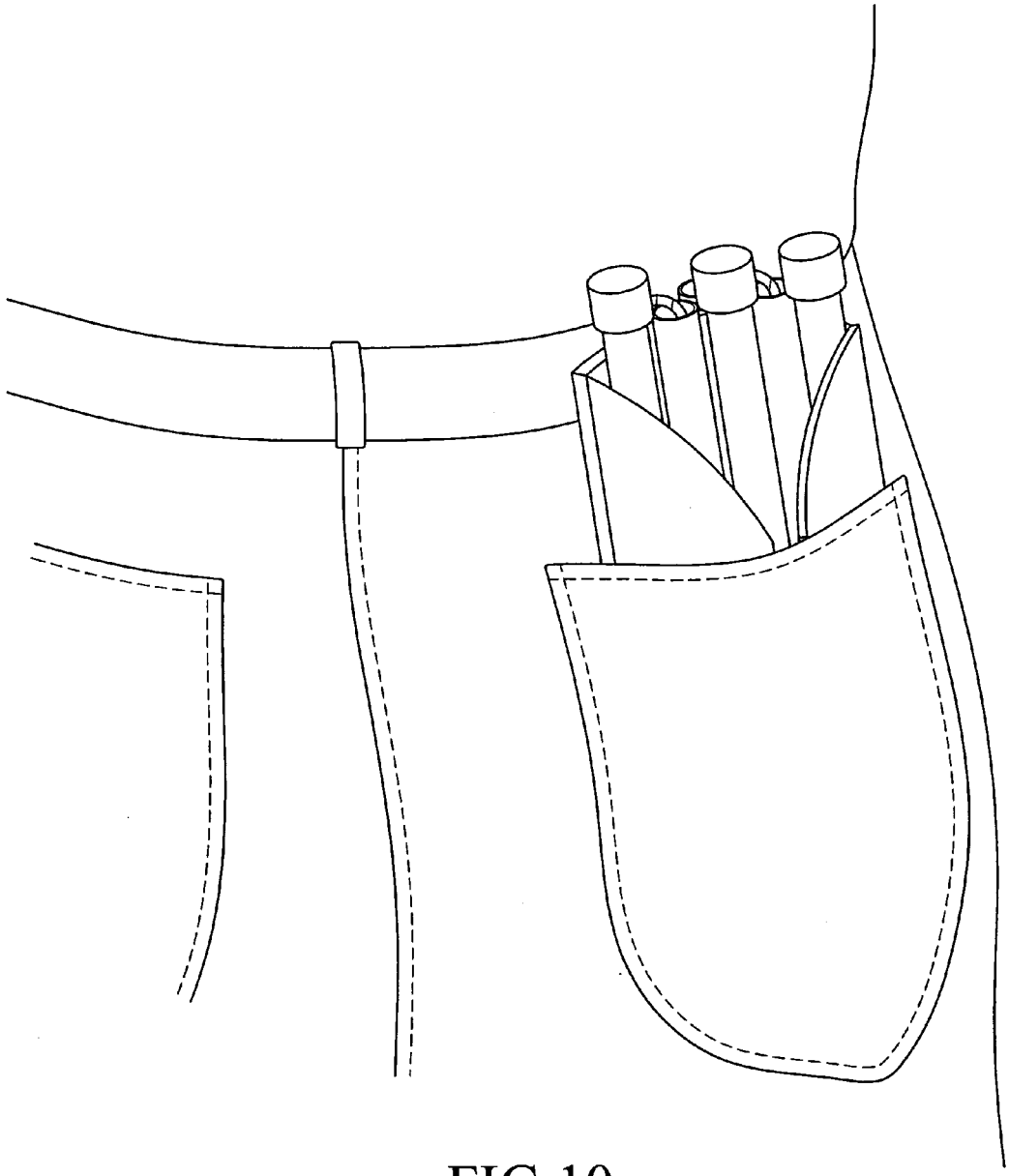
FIG. 10 is a view in perspective of the folded platform of the present invention being stored in a pant pocket.

When folded, the platform of the present invention has reduced storage requirements. For instance, FIG. 9 shows the folded platform being stored in a fanny pack. FIG. 10 shows the folded platform being stored in pants hip pocket. The platform of the present invention is accordingly easy to use, easy to transport, and easy to store.

What is claimed is:

1. A portable collapsible platform having at least three outwardly-inclined legs and a platform supported thereby, said platform being comprised of dimensionally-stable foldable sections, said legs each having multiple connectable sections, an uppermost portion of each of said legs being adapted to be removably inserted within a corresponding-sized outwardly-angled hole at a centrally-positioned location at the underside of said platform, whereby said legs extend from said centrally-positioned location outwardly therefrom in a supporting relationship to said platform, said legs being maintained in biased relationship to said underside of said platform within said outwardly-angled holes and to each other by an elastic cord or cable which extends between said underside of said platform and a lowermost section of said legs, with said elastic cord or cable extending through each said respective sections of said legs, said elastic cord or cable being tensioned such that said sections of said legs while in assembled position being biased toward the underside of said platform and maintained in supporting relationship to each other, and said legs stored in a non-supporting position by separating said sections of each leg from one another by extension of said elastic cord or cable, and said separated sections of each leg placed onto an uppermost surface of said platform.

2. The portable platform of claim 1, wherein said dimensionally-stable foldable sections of said platform are comprised of wood, metal or plastic.

3. The portable platform of claim 1, wherein said uppermost sections of said legs are engaged within corresponding-sized outwardly-angled holes in a swivel member rotatably mounted to said underside of said platform.

4. The portable platform of claim 3, wherein said holes are approximately 0.5 inch deep and outwardly inclined at an angle of approximately 15 to 20 degrees to the vertical axis.

5. The portable platform of claim 3, wherein said dimensionally-stable foldable sections are hinged with respect to each other.

6. The portable platform of claim 3, wherein said dimensionally-stable foldable sections of said platform are comprised of wood, metal or plastic.

7. The portable platform of claim 3, wherein said legs are attached to each other at a lower portion thereof by cables extending therebetween to provide dimensional stability.

8. The portable platform of claim 3, wherein said legs are outwardly inclined from said centrally-positioned location at an angle of approximately 15 to 20 degrees to the vertical axis.

9. The portable platform of claim 3, wherein said leg sections are approximately 7 to 10 inches in length.

10. The portable platform of claim 3, wherein said legs are comprised of metal, plastic or carbon fiber.

11. The portable platform of claim 3, wherein said foldable platform is comprised of three foldable sections, with the outermost foldable sections being adapted to fold inwardly toward an uppermost surface of said platform and in encompassing relationship to a middle section of said platform.

12. The portable platform of claim 1, wherein said legs are attached to each other at a lower portion thereof by cables extending therebetween to provide dimensional stability.

13. The portable platform of claim 1, wherein said legs are outwardly inclined from said centrally-positioned location at an angle of approximately 15 to 20 degrees to the vertical axis.

14. The portable platform of claim 1, wherein said leg sections are approximately 7 to 10 inches in length.

15. The portable platform of claim 1, wherein said legs are comprised of metal, plastic or carbon fiber.

16. The portable platform of claim 1, wherein said foldable platform is comprised of three foldable sections, with the outermost foldable sections being adapted to fold inwardly toward an uppermost surface of said platform and in encompassing relationship to a middle section of said platform.

17. The portable platform of claim 1, wherein said dimensionally-stable foldable sections are hinged with respect to each other.

* * * * *